US005152367A

United States Patent [19]

Cole

[11] Patent Number: 5,152,367

[45] Date of Patent: Oct. 6, 1992

[54] SAFETY NET IDENTIFIER

[75] Inventor: Barry A. Cole, Colchester, Conn.

[73] Assignee: Sinco, Inc., East Hampton, Conn.

[21] Appl. No.: 765,143

[22] Filed: Sep. 25, 1991

[51] Int. Cl.[5] ..... E04G 21/32

[52] U.S. Cl. ..... 182/18; 182/138

[58] Field of Search ..... 182/18, 137, 138, 139, 182/140

[56] References Cited

U.S. PATENT DOCUMENTS

| | | | |
|---|---|---|---|
| 3,527,319 | 9/1970 | Pedley | 182/139 |
| 4,211,332 | 8/1980 | Pitman | 182/18 |
| 4,253,544 | 3/1981 | Dalmaso | 182/18 |
| 4,844,200 | 7/1989 | Flint | 182/18 |
| 4,982,813 | 1/1991 | Starr | 182/138 |

OTHER PUBLICATIONS

Sinco Handbook of Passive Fall Protection date: 1985.

*Primary Examiner*—Reinaldo P. Machado

*Attorney, Agent, or Firm*—Chilton, Alix & Van Kirk

[57] ABSTRACT

A safety net identifier employs an identifier filament which is woven, laced, twisted or otherwise incorporated with the cords of the safety net. The identifier filament is impervious to ultraviolet resistant coating so that the safety net does not appear exteriorly distinguishable from other nets which do not employ the identifier. In one embodiment, the filament comprises a folded ribbon which is imprinted with the net manufacturer and other pertinent information concerning the safety net.

20 Claims, 1 Drawing Sheet

SAFETY NET IDENTIFIER

BACKGROUND OF THE INVENTION

This invention relates generally to personnel safety nets which are used in the construction industry. More particularly, the present invention relates to safety nets which are mounted at construction or industrial sites to provide fall protection at elevated work locations and to techniques and devices for identifying the source of the safety nets.

Personnel safety nets are conventionally used in high-rise or elevated construction projects to provide fall protection for the workers and also to provide a debris containment system to protect individuals below the elevated work site. Personnel safety nets which are used to provide fall protection are subject to strict governmental regulation and are required to comply with various safety standards. Applicable regulations and standards typically require that the safety nets be marked with a tag which identifies the manufacturer as well as other information including testing authorities and relevant dates. However, in practice, especially when the safety nets have been placed in service for an extended time, it is quite common for the identification tags to be removed from the safety nets—either accidentally or intentionally. Removal of the identification tags may occur while the nets are at the construction site or are in transit or are in use. It is also common for the construction contractors to employ nets from different manufacturers and sources on a given work site.

Because of the high potential for injuries and death due to malfunction of personnel safety nets, it is very important that the manufacturer of the safety net be readily identified. The identification is desired both from a liability standpoint and also from a standpoint of quality control and improving safety in the industry. Identification of the manufacturer is also a key factor in accident reconstruction.

Until recently there were relatively few certified fabricators of personnel safety nets. For the most part each manufacturer had a distinct netting style which provided a suitable indication of manufacture regardless of whether identification tags or labels were attached to the net. However, the number of manufacturers of personnel safety nets has dramatically increased and the various styles are no longer sufficiently distinctive from a visual perspective to be an indication of source. Because the identification of a company as manufacturer of a given safety net can have very significant consequences, it has become increasingly important that the manufacturer of the safety net be correctly identified and that the identification process not be compromised by vandalism, accident or in some extreme cases—outright fraud.

For the safety nets to which the present invention relates, the nets have a mesh configuration comprised of numerous twisted cords. The cords are composed of strands which are twisted together. The individual strands are often further composed of yarns which are twisted together. A tar-like substance is applied to the netting to form a substantially black coating to enhance resistance to ultraviolet radiation and to diminish the effects of chafing.

SUMMARY OF THE INVENTION

Briefly stated, the invention in a preferred form is a safety net having a mesh net configuration comprising a plurality of twisted cords. A selected portion of at least one of the cords includes an identification filament. The filament may be woven, laced, twisted or otherwise incorporated into at least a portion of one or more net cords. An ultraviolet resistant coating is applied to the mesh net so that the identification filament is not readily exteriorily visible and the safety net would have the same overall exterior appearance with or without the identification filament. The identification filament is composed of material which is impervious to the ultraviolet resistant coating. The identification filament may be readily identified and distinguished from the rest of the cord. The identification filament may have a unique color, marking, pattern, dimension or location. Filaments may be used in pre-established combinations.

In one embodiment of the invention, the identification filament takes the form of a ribbon which is also affixed with text identifying the manufacturer and the relevant additional information concerning the date of manufacture, composition material, test date, and customer identification for the net.

An object of the invention is to provide a new and improved identification scheme for identifying the source of a safety net.

Another object of the invention is to provide a new and improved safety net identifier which cannot be readily detected by vandals or damaged by weather, or readily accidentally or intentionally removed from the safety net.

A further object of the invention is to provide a new and improved safety net identifier which can be incorporated into a safety net in an efficient and cost effective manner to identify the source, and/or relevant information for the safety net in a highly effective and reliable manner.

Other objects and advantages of the invention will become apparent from the drawings and the specification.

DETAILED DESCRIPTION OF THE PREFERRED EMBODIMENTS

Figure 1:
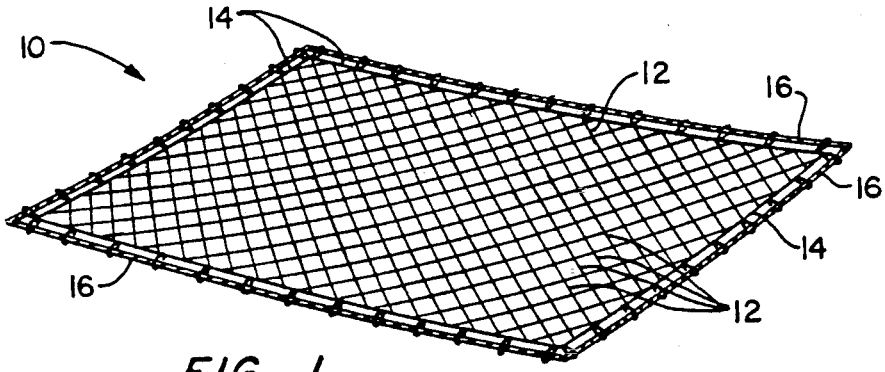
FIG. 1 is a perspective view of a safety net incorporating a safety net identifier in accordance with the present invention.

With reference to the drawings wherein like numerals represent like parts throughout the figures, a personnel safety net which incorporates a safety net identifier in accordance with the present invention is generally designated by the numeral 10. Safety net 10 is a type of net which may be employed as a fall protection barrier at an elevated work site and includes a mesh configuration. The safety net comprises a plurality of cords 12, including a peripheral border rope 14. The safety net 10 may be suspended from cables 16 or other support structures. The safety net 10 is generally conventional except for the identifier or tracer modifications disclosed herein.

Figure 2:
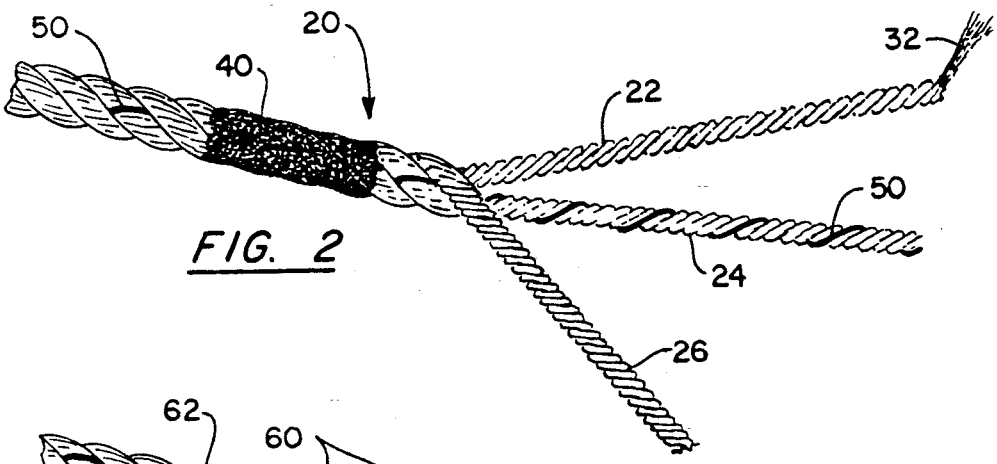
FIG. 2 is an enlarged fragmentary perspective view, partly broken away, in partially unraveled form of a safety net cord incorporating an identifier in accordance with the present invention.

With reference to FIG. 2, the safety net comprises at least one representative cord 20 which may be a border rope or constitute an interior mesh cord. Cord 20 typically comprises, for example, twisted strands 22, 24, 26. Each of the strands in turn is composed of twisted yarns 32 and/or filaments. The cords including the strands and the yarns are covered with a tar-like substance which provides a coating 40 to protect the net materials from ultraviolet radiation (sunlight) and to increase the resistance of the netting to chafing. The tar-like coating 40 penetrates throughout the cords and the strands so that the composite fibers are essentially embedded together by the coating.

In accordance with one embodiment of the invention, one or more of the cords incorporates an identifier filament 50 which is twisted into the cord along with the other yarns and strands. The identifier filament may be composed of vinyl, plastic or other suitable material which is impervious to the ultraviolet resistant coating 40 and has a distinct physical appearance compared to that of the other composite material of the cords. Identifier filament 50 may have a unique color, marking or dimension compared to the other composite materials. Two or more filaments 50 (only one illustrated) may also be incorporated into the cord 20. The cord which incorporates the identifier filament may be the border rope 12 or any other cord(s) 14 of the mesh. The identifier filament 50 is also preferably resistant to ultraviolet radiation and chafing.

The identifier filament 50 may be incorporated into the cord 20 during the cord manufacturing process and/or incorporated into the net during or after the mesh net forming process. After the protective coating 40 is applied to substantially the entire surface of the finished net, the resultant safety net is exteriorly visually indistinguishable from a conventional safety net without the identifier filament. The identifier filament may be readily distinguished, however, by unraveling the cord and/or removing or allowing the coating 40 to disengage from the cord. The identifier filament 50 may be positioned in a specific location or form a recognizable pattern. A single filament or multiple filaments which have a pre-established length may be employed as an identification indicator. The pattern, location, color, markings, length or number combinations of the identifier filament may each serve as identification indicia to uniquely identify the source or manufacturer for the safety net. The foregoing indicia or combinations thereof may also be keyed to dates, customers, batch numbers and other relevant information.

Figure 3:
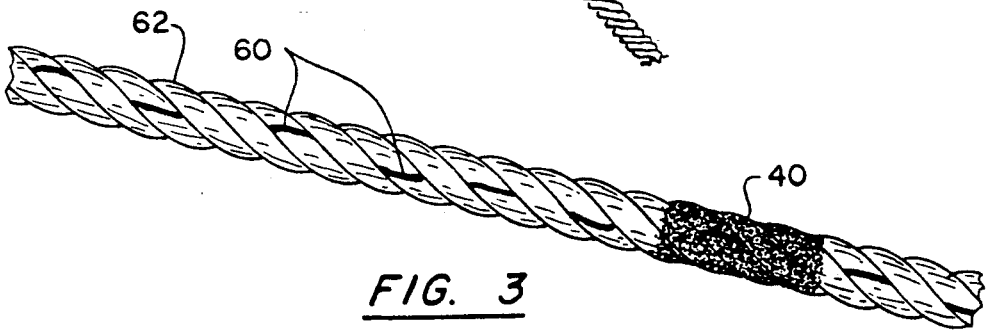
FIG. 3 is an enlarged fragmentary side view, partly broken away, of a second embodiment of a safety net cord incorporating an identifier in accordance with the present invention.

In a second embodiment of a safety net identifier illustrated in FIG. 3, an identifier filament 60 is laced through the safety net cord 62 after the rope has essentially been woven and twisted. The laced identifier filament 60 may be interposed at a border rope or any of the cords of the safety net. Once the ultraviolet resistant coating 40 has been applied to the cord 60 and the rope 62 itself, the safety net will not be easily identifiable without penetrating the rope or at least partially removing the coating 40. It should be appreciated that the ultraviolet resistant coating essentially embeds all of the composite fibers or material into a solid mass. It would be evident if one were to strip out or remove the identifier filament 60 since the removed strand would leave tracks next to adjacent strands, fibers or yarns in the remaining safety net. At any rate, since the identifier filament is preferably woven, laced or twisted through the cord, removal of the identifier filament 60 without destroying the cordage of the net structure is very problematical.

Figure 4:
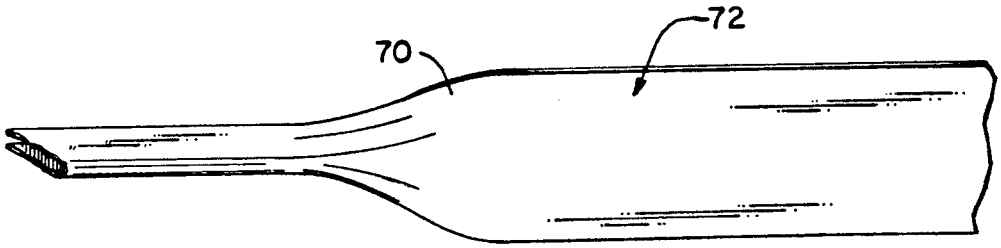
FIG. 4 is an enlarged fragmentary perspective view, partly broken away, of a third embodiment of a safety net identifier in accordance with the present invention.

With reference to FIG. 4, a third embodiment of an identifier filament may essentially take the form of a ribbon 70. The ribbon 70 is imprinted with text 72 identifying the manufacturer, the dates of manufacture, the testing organization and the test reading as well as additional information and data such as the serial number for the safety net. The ribbon 70 may be folded or twisted to form a filament and then twisted, wound and/or laced into the safety net as previously described. The ribbon 70 is composed of plastic, vinyl or other suitable material which is impervious to the ultraviolet coating 40. Consequently, the safety net manufacturer or source is identified by locating the identifier ribbon, removing the coating 40 and then removing the ribbon or portions of the ribbon from the rest of the safety net and/or unfolding the ribbon in place to inspect the text 72 and thereby identify the manufacturer and ascertain other relevant data.

It should be appreciated that the safety net identifiers or tracers as described would neither be readily detected by vandals nor readily removed from the safety net without the removal being detected. Furthermore, the identification of the manufacturer or source of the safety net would not be subject to accidental or intentional removal of tags or other identification means and/or damage by the weather such as commonly occurs with labels and tags. Consequently, should the safety net 10 be involved in an accident and/or be returned to a manufacturer for repairs or evaluation, the manufacturer will be able to easily verify the source as well as ascertain other useful information concerning the safety net described. The identifiers or tracers provide an efficient and reliable means for identifying the manufacturer to thereby protect both the industry and the manufacturer from maliciousness or subterfuge concerning the source of the safety net.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A safety net or the like comprising:

a plurality of cords configured to form a mesh net;

an identifier filament having a physical appearance distinct from said cords, said filament positioned to extend at least a segment of at least one of said cords; and an opaque coating which is resistant to ultraviolet radiation covering said cords and said filament, said identifier filament being impervious to said coating, said coating being removable from said identifier filament to permit inspection thereof.

2. The safety net of claim 1 wherein said identifier filament is woven into at least one of said cords.

3. The safety net of claim 1 wherein said identifier filament is laced into at least one of said cords.

4. The safety net of claim 1 wherein said identifier filament comprises a ribbon.

5. The safety net of claim 4 wherein said identifier filament has text which identifies the source of the safety net.

6. The safety net of claim 1 wherein said identifier filament has a color different from said cords.

7. The safety net of claim 1 wherein said segment is a portion of a peripheral border cord of said mesh net.

8. The safety net of claim 1 wherein said identifier filament is composed of vinyl material.

9. The safety net of claim 1 wherein said identifier filament is composed of plastic material.

10. A method for identifying a safety net or the like comprising:

(a) forming a mesh net from a plurality of cords;

(b) selecting an identifier filament which has a composition impervious to an exterior net coating and an appearance distinctive from said cords;

(c) positioning said identifier filament in at least one of said cords; and (d) coating said mesh net and said identifier filament with said coating so that said identifier strand is not externally distinguishable from the cords of said net.

11. The method of claim 10 wherein step (c) further comprises weaving said filament with a said cord.

12. The method of claim 10 wherein step (c) further comprises lacing said filament with a said cord.

13. The method of claim 10 further comprising imprinting text on said identifier filament.

14. The method of claim 13 further comprising folding said filament prior to step (c).

15. A safety net or the like comprising:

a plurality of cords configured to form a mesh net;

at least one identifier filament having a physical appearance distinct from said cords, said filament positioned to extend along at least a segment of at least one of said cords; and a generally opaque coating covering said cords and said filament, said identifier filament being impervious to said coating to permit inspection thereof.

16. The safety net of claim 15 wherein said at least one identifier filament is woven into at least one of said cords.

17. The safety net of claim 15 wherein said at least one identifier filament is laced into at least one of said cords.

18. The safety net of claim 15 wherein said at least one identifier filament comprises a ribbon.

19. The safety net of claim 15 wherein said at least one identifier filament has text which identifies the source of the safety net.

20. The safety net of claim 15 wherein said at least one identifier filament has a color different from said cords.

* * * * *